US007604914B2

(12) United States Patent
Lin et al.

(10) Patent No.: US 7,604,914 B2
(45) **Date of Patent: *Oct. 20, 2009**

(54) IMAGING MEMBER

(75) Inventors: Liang-bih Lin, Rochester, NY (US); Jin Wu, Webster, NY (US); Daniel Levy, Rochester, NY (US); Francisco Lopez, Rochester, NY (US); Marc Livecchi, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 287 days.

This patent is subject to a terminal disclaimer.

(21) Appl. No.: 11/403,981

(22) Filed: Apr. 13, 2006

(65) Prior Publication Data

US 2007/0243476 A1 Oct. 18, 2007

(51) Int. Cl.
*G03G 5/14* (2006.01)

(52) U.S. Cl. ..... 430/65; 430/60; 399/159

(58) Field of Classification Search ..... 430/60, 430/65; 399/159
See application file for complete search history.

(56) References Cited

U.S. PATENT DOCUMENTS

| | | | | |
|---|---|---|---|---|
| 4,464,450 | A | 8/1984 | Teuscher | |
| 4,518,669 | A | 5/1985 | Yashiki | |
| 4,579,801 | A | 4/1986 | Yashiki | |
| 4,775,605 | A | 10/1988 | Seki | |
| 5,017,449 | A | 5/1991 | Yoshihara | |
| 5,344,734 | A | 9/1994 | Monbaliu | |
| 5,385,796 | A | 1/1995 | Spiewak | |
| 5,391,448 | A * | 2/1995 | Katayama et al. | 430/65 |
| 5,449,573 | A | 9/1995 | Aoki | |
| 5,456,989 | A * | 10/1995 | Nogami et al. | 430/58.05 |
| 5,489,496 | A | 2/1996 | Katayama | |
| 5,595,847 | A * | 1/1997 | Nogami et al. | 430/64 |
| 5,641,599 | A | 6/1997 | Markovics | |
| 5,656,407 | A | 8/1997 | Kawahara | |
| 5,721,080 | A | 2/1998 | Terrell | |
| 5,928,824 | A | 7/1999 | Obinata | |
| 6,180,309 | B1 | 1/2001 | Maty | |
| 6,200,716 | B1 | 3/2001 | Fuller | |
| 6,207,334 | B1 | 3/2001 | Dinh | |
| 7,312,007 | B2 | 12/2007 | Lin et al. | |
| 2003/0224268 | A1 * | 12/2003 | Ikuno et al. | 430/57.3 |
| 2003/0232265 | A1 * | 12/2003 | Yamanami et al. | 430/65 |
| 2007/0049677 | A1 * | 3/2007 | Wu et al. | 524/430 |

FOREIGN PATENT DOCUMENTS

JP 2004219904 A * 8/2004

OTHER PUBLICATIONS

Diamond, Arthur S & David Weiss (eds.) Handbook of Imaging Materials, 2nd ed.. New York: Marcel-Dekker, Inc. (Nov. 2001) pp. 145-164.*

English machine translation of JP 2004-219904 (Aug. 2004).*

Amino Coating Resins, DIC Corporation, <http://www.dic.co.jp/en/products/coating/amino/index.html>, retrieved Jun. 2009.*

* cited by examiner

*Primary Examiner*—Christopher RoDee
(74) *Attorney, Agent, or Firm*—Pillsbury Winthrop Shaw Pittman LLP

(57) ABSTRACT

The presently disclosed embodiments relate in general to electrophotographic imaging members, such as layered photoreceptor structures, and processes for making and using the same. More particularly, the embodiments pertain to a photoreceptor undercoat layer that includes polyol and aminoplast resins to improve image quality.

16 Claims, No Drawings

IMAGING MEMBER

BACKGROUND

Herein disclosed are imaging members, such as layered photoreceptor devices, and processes for making and using the same. The imaging members can be used in electrophotographic, electrostatographic, xerographic and like devices, including printers, copiers, scanners, facsimiles, and including digital, image-on-image, and like devices. More particularly, the embodiments pertain to an imaging member or a photoreceptor that incorporates specific molecules, namely polyol and aminoplast resins, to improve image quality.

Electrophotographic imaging members, e.g., photoreceptors, typically include a photoconductive layer formed on an electrically conductive substrate. The photoconductive layer is an insulator in the substantial absence of light so that electric charges are retained on its surface. Upon exposure to light, the charge is dissipated.

In electrophotography, also known as Xerography, electrophotographic imaging or electrostatographic imaging, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. The radiation selectively dissipates the charge on the illuminated areas of the photoconductive insulating layer while leaving behind an electrostatic latent image. This electrostatic latent image may then be developed to form a visible image by depositing oppositely charged particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

An electrophotographic imaging member may be provided in a number of forms. For example, the imaging member may be a homogeneous layer of a single material such as vitreous selenium or it may be a composite layer containing a photoconductor and another material. In addition, the imaging member may be layered. These layers can be in any order, and sometimes can be combined in a single or mixed layer.

The demand for improved print quality in xerographic reproduction is increasing, especially with the advent of color. Common print quality issues are strongly dependent on the quality of the undercoat layer (UCL). Conventional materials used for the undercoat or blocking layer have been problematic. In certain situations, a thicker undercoat is desirable, but the thickness of the material used for the undercoat layer is limited by the inefficient transport of the photoinjected electrons from the generator layer to the substrate. If the undercoat layer is too thin, then incomplete coverage of the substrate results due to wetting problems on localized unclean substrate surface areas. The incomplete coverage produces pin holes which can, in turn, produce print defects such as charge deficient spots (CDS) and bias charge roll (BCR) leakage breakdown. Other problems include "ghosting," which is thought to result from the accumulation of charge somewhere in the photoreceptor. Removing trapped electrons and holes residing in the imaging members is the key to preventing ghosting. During the exposure and development stages of xerographic cycles, the trapped electrons are mainly at or near the interface between charge generating layer (CGL) and undercoating layer (UCL) and holes mainly at or near the interface between charge generating layer and charge transport layer (CTL). The trapped charges can migrate according to the electric field during the transfer stage, where the electrons can move from the interface of CGL/UCL to CTL/CGL or the holes from CTL/CGL to CGL/UCL and became deep traps that are no longer mobile. Consequently, when a sequential image is printed, the accumulated charge results in image density changes in the current printed image that reveals the previously printed image. Thus, there is a need, which the present embodiments address, for a way to minimize or eliminate charge accumulation in photoreceptors, without sacrificing the desired thickness of the undercoat layer.

The terms "charge blocking layer" and "blocking layer" are generally used interchangeably with the phrase "undercoat layer."

Conventional photoreceptors and their materials are disclosed in Katayama et al., U.S. Pat. No. 5,489,496; Yashiki, U.S. Pat. No. 4,579,801; Yashiki, U.S. Pat. No. 4,518,669; Seki et al., U.S. Pat. No. 4,775,605; Kawahara, U.S. Pat. No. 5,656,407; Markovics et al., U.S. Pat. No. 5,641,599; Monbaliu et al., U.S. Pat. No. 5,344,734; Terrell et al., U.S. Pat. No. 5,721,080; and Yoshihara, U.S. Pat. No. 5,017,449, which are herein all incorporated by reference.

More recent photoreceptors are disclosed in Fuller et al., U.S. Pat. No. 6,200,716; Maty et al., U.S. Pat. No. 6,180,309; and Dinh et al., U.S. Pat. No. 6,207,334, which are all herein incorporated by reference.

Conventional undercoat or charge blocking layers are also disclosed in U.S. Pat. No. 4,464,450; U.S. Pat. No. 5,449,573; U.S. Pat. No. 5,385,796; and Obinata et al, U.S. Pat. No. 5,928,824, which are all herein incorporated by reference.

SUMMARY

According to embodiments illustrated herein, there is provided a way in which print quality is improved, for example, ghosting is minimized or substantially eliminated in images printed in systems with high transfer current.

In particular, an embodiment provides an electrophotographic imaging member, comprising a substrate, an undercoat layer disposed on the substrate, wherein the undercoat layer further comprises a polyol resin, an aminoplast resin, and a metal oxide dispersed therein, and at least one imaging layer formed on the undercoat layer.

Embodiments also provide an electrophotographic imaging member, comprising a substrate, an undercoat layer disposed on the substrate, wherein the undercoat layer further comprises an acrylic polyol resin, a melamine resin, and titanium oxide dispersed therein, and a charge transport layer formed on the undercoat layer.

In another embodiment, there is described an image forming apparatus for forming images on a recording medium comprising (a) an electrophotographic imaging member having a charge-retentive surface to receive an electrostatic latent image thereon, wherein the electrophotographic imaging member comprises a substrate, an undercoat layer disposed on the substrate, wherein the undercoat layer further comprises a polyol resin, an aminoplast resin, and a metal oxide dispersed therein, and at least one imaging layer formed on the undercoat layer, (b) a development component adjacent to the charge-retentive surface for applying a developer material to the charge-retentive surface to develop the electrostatic latent image to form a developed image on the charge-retentive surface, (c) a transfer component adjacent to the charge-retentive surface for transferring the developed image from the charge-retentive surface to a copy substrate, and (d) a fusing component adjacent to the copy substrate for fusing the developed image to the copy substrate.

DETAILED DESCRIPTION

In the following description, it is understood that other embodiments may be utilized and structural and operational changes may be made without departure from the scope of the present embodiments disclosed herein.

The present embodiments relate to a photoreceptor having an undercoat layer which incorporates an additive to the formulation that helps reduce, and preferably substantially eliminates, specific printing defects in the print images.

According to embodiments, an electrophotographic imaging member is provided, which generally comprises at least a substrate layer, an undercoat layer, and an imaging layer. The undercoating layer is generally located between the substrate and the imaging layer, although additional layers may be present and located between these layers. The imaging member may also include a charge generating layer and a charge transport layer. This imaging member can be employed in the imaging process of electrophotography, where the surface of an electrophotographic plate, drum, belt or the like (imaging member or photoreceptor) containing a photoconductive insulating layer on a conductive layer is first uniformly electro statically charged. The imaging member is then exposed to a pattern of activating electromagnetic radiation, such as light. The radiation selectively dissipates the charge on the illuminated areas of the photoconductive insulating layer while leaving behind an electrostatic latent image. This electrostatic latent image may then be developed to form a visible image by depositing oppositely charged particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

Thick undercoat layers are desirable for photoreceptors due to their life extension and carbon fiber resistance. Furthermore, thicker undercoat layers make it possible to use less costly substrates in the photoreceptors. Such thick undercoat layers have been developed, such as one developed by Xerox Corporation and disclosed in U.S. Pat. No. 7,312,007, which is hereby incorporated by reference. However, due to insufficient electron conductivity in dry and cold environments, the residual potential in conditions known as "J zone"(10% room humidity and 70° F.) is unacceptably high (e.g., >150V) when the undercoat layer is thicker than 15 μm.

Common print quality issues are strongly dependent on the quality of the undercoat layer. Conventional materials used for the undercoat or blocking layer have been problematic because print quality issues are strongly dependent on the quality of the undercoat layer. For example, charge deficient spots and bias charge roll leakage breakdown are problems the commonly occur. Another problem is "ghosting," which is thought to result from the accumulation of charge somewhere in the photoreceptor. Consequently, when a sequential image is printed, the accumulated charge results in image density changes in the current printed image that reveals the previously printed image.

There have been formulations developed for undercoat layers that, while suitable for their intended purpose, do not address the ghosting effect problem. To alleviate the problems associated with charge block layer thickness and high transfer currents, the incorporation of specific resins to a formulation containing titanium oxide ($TiO_2$) has shown to substantially reduce and preferably eliminate ghosting failure in xerographic reproductions. The addition of these resins, namely polyol and aminoplast resins, has shown to be useful in reducing ghosting.

In various embodiments, the polyol resin used is acrylic polyol resin. Other polyol resins that may be used are selected from, but are not limited to, the group consisting of polyglycol, polyglycerol and mixtures thereof. The aminoplast resin used with the embodiments may be selected from, but are not limited to, the group consisting of urea, melamine and mixtures thereof. In embodiments, a metal oxide is used, in combination with the resins, to form the undercoat layer formulation. The metal oxide is dispersed in the resins and the dispersion is subjected to heat. In embodiments, the metal oxide is has a size diameter of from about 5 to about 300 nm, a powder resistance of from about $1\times10^3$ to about $6\times10^4$ ohm/cm when applied at a pressure of from about 50 to about 650 kg/cm$^2$. In one embodiment, $TiO_2$ is used as the metal oxide in the undercoat layer formulation.

In embodiments, $TiO_2$ can be either surface treated or untreated. Surface treatments include, but are not limited to aluminum laurate, alumina, zirconia, silica, silane, methicone, dimethicone, sodium metaphosphate, and the like and mixtures thereof. Examples of $TiO_2$ include MT-150W (surface treatment with sodium metaphosphate, Tayca Corporation), STR-60N (no surface treatment, Sakai Chemical Industry Co., Ltd.), FTL-100 (no surface treatment, Ishihara Sangyo Laisha, Ltd.), STR-60 (surface treatment with Al2O3, Sakai Chemical Industry Co., Ltd.), TTO-55N (no surface treatment, Ishihara Sangyo Laisha, Ltd.), TTO-55A (surface treatment with Al2O3, Ishihara Sangyo Laisha, Ltd.), MT-150AW (no surface treatment, Tayca Corporation), MT-150A (no surface treatment, Tayca Corporation), MT-100S (surface treatment with aluminum laurate and alumina, Tayca Corporation), MT-100HD (surface treatment with zirconia and alumina, Tayca Corporation), MT-100SA (surface treatment with silica and alumina, Tayca Corporation), and the like.

Other metal oxides that can be used with the embodiments include, but are not limited to, zinc oxide, tin oxide, aluminum oxide, silicon oxide, zirconium oxide, indium oxide, molybdenum oxide, and mixtures thereof.

Undercoat layer binder materials are well known in the art. Typical undercoat layer binder materials include, for example, polyesters, MOR-ESTER 49,000 from Morton International Inc., VITEL PE-100, VITEL PE-200, VITEL PE-200D, and VITEL PE-222 from Goodyear Tire and Rubber Co., polyarylates such as ARDEL from AMOCO Production Products, polysulfone from AMOCO Production Products, polyurethanes, and the like. Other examples of suitable undercoat layer binder materials include, but are not limited to, a polyamide such as Luckamide 5003 from DAINIPPON Ink and Chemicals, Nylon 8 with methylmethoxy pendant groups, CM 4000 and CM 8000 from Toray Industries Ltd and other N-methoxymethylated polyamides, such as those prepared according to the method described in Sorenson and Campbell "Preparative Methods of Polymer Chemistry" second edition, p. 76, John Wiley and Sons Inc. (1968), and the like and mixtures thereof. These polyamides can be alcohol soluble, for example, with polar functional groups, such as methoxy, ethoxy and hydroxy groups, pendant from the polymer backbone. Another examples of undercoat layer binder materials include phenolic-formaldehyde resin such as VARCUM 29159 from OXYCHEM, aminoplast-formaldehyde resin such as CYMEL resins from CYTEC, poly (vinyl butyral) such as BM-1 from Sekisui Chemical, and the like and mixtures thereof.

The weight/weight ratio of the polyol and aminoplast resins in the undercoat layer formulation is from about 5/95 to about 95/5, or from about 25/75 to about 75/25. The weight/weight ratio of the polyol and aminoplast resins to the titanium oxide in the undercoat layer formulation is from about 10/90 to about 90/10, or from about 30/70 to about 70/30. In embodiments, the aminoplast resin is present in an amount of from about 5% to about 80%, or from about 5% to about 75%, or from about 20% to about 80%, by weight of the total weight of the undercoat layer. In embodiments, the polyol resin is present in an amount of from about 5% to about 80%, or from about 5% to about 75%, or from about 20% to about 80%, by weight of the total weight of the undercoat layer. In embodiments, the $TiO_2$ is present in an amount of from about 10% to 90%, or from about 20% to about 80% by weight of the total weight of the undercoat layer.

The undercoat layer may also include a polymeric binder with the polyol resin, aminoplast resin and $TiO_2$ combination. The weight/weight ratio of the resins and $TiO_2$ combination and the binder is from about 20/80 to about 80/20, or from about 40/60 to about 65/35.

In various embodiments, the undercoat layer further contains an optional light scattering particle. In various embodiments, the light scattering particle has a refractive index different from the binder and has a number average particle size greater than about 0.8 μm. The light scattering particle can be amorphous silica or silicone ball. In various embodiments, the light scattering particle can be present in an amount of from about 0% to about 10% by weight of the total weight of the undercoat layer.

In various embodiments, the undercoat layer has a thickness of from about 0.1 μm to about 40 μm, or from about 2 μm to about 25 μm, or from about 10 μm to about 20 μm. In further embodiments, the resins/metal oxide combination is present in an amount of from about 20% to about 80%, or from about 40% to about 70%, by weight of the total weight of the undercoat layer.

The undercoat layer may be applied or coated onto a substrate by any suitable technique known in the art, such as spraying, dip coating, draw bar coating, gravure coating, silk screening, air knife coating, reverse roll coating, vacuum deposition, chemical treatment and the like. Additional vacuuming, heating, drying and the like, may be used to remove any solvent remaining after the application or coating to form the undercoat layer.

All the patents and applications referred to herein are hereby specifically, and totally incorporated herein by reference in their entirety in the instant specification.

It will be appreciated that several of the above-disclosed and other features and functions, or alternatives thereof, may be desirably combined into many other different systems or applications. Various presently unforeseen or unanticipated alternatives, modifications, variations or improvements therein may be subsequently made by those skilled in the art which are also intended to be encompassed by the following claims.

EXAMPLES

The examples set forth herein below and are illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter.

Comparative Example I

A conventional undercoat layer dispersion, known as UC79, was prepared as follows: In a 4 oz. glass bottle, 16.7 g of $TiO_2$ (MT-150W, Tayca Co., Japan) and 5.2 g of phenolic resin (Varcum 29159, Oxychem Co.) and 5.3 g of a melamine resin (Cymel 323, Cytec Co.) were mixed with 15 g of xylene and 15 g of n-butanol. After mixing, 120 g of 0.4-0.6 mm diameter zirconium oxide beads were added and roll milled for overnight. The reference device was prepared by coating a device with the undercoat layer dispersion at 5 μm at a curing condition of 140 C/30 min. Subsequently, a 0.2-0.5 μm charge generating layer comprised of chlorophthalocyaninne and a 29 μm charge transport layer comprised of N,N'-bis(methylphenyl)-1,1-biphenyl-4,4'-diamine, a polycarbonate, and polytetrafluoroethylene (PTFE) particles were coated.

Comparative Example II

A conventional undercoat layer dispersion, as described above, was prepared. The reference device was prepared by coating a conventional three-component device with the undercoat layer dispersion at 5 μm at a curing condition of 140 C/30 min. Subsequently, a 0.2-0.5 μm charge generating layer comprised of chlorophthalocyaninne and a 29 μm charge transport layer comprised of N,N'-bis(methylphenyl)-1,1-biphenyl-4,4'-diamine, a polycarbonate, and PTFE particles were coated.

Example I

An undercoat layer dispersion was prepared as follows: preparation of the undercoating layer dispersion was done by mixing 18.5 gm of titanium oxide (MT-150W, Tayca Co., Japan), 6.25 gm of Cymel 323 melamine resin (Cytec Co.), 6.0 gm of Paraloid AT-400 acrylic polyol resin (Rohm Haas), and 32 gm of methylethyl ketone (MEK) in a 4 oz. glass bottle. After mixing, 140 gm of 0.4-0.6 mm $ZrO_2$ beads were added and roll milled for two days. The final dispersion was collected through a 20 μm Nylon filter and the final solid percentage was measured to be 42.5%. An experimental device was prepared by coating the new undercoat layer at 5 μm at a curing condition of 140 C/30 min. Subsequently, a 0.2-0.5 μm charge generating layer comprised of chlorophthalocyaninne and a 29 μm charge transport layer comprised of N,N'-bis(methylphenyl)-1,1-biphenyl-4,4'-diamine, a polycarbonate, and PTFE particles were coated.

The above prepared photoreceptor devices were tested in a scanner set to obtain photo-induced discharge characteristic (PIDC) curves, sequenced at one charge-erase cycle followed by one charge-expose-erase cycle, wherein the light intensity was incrementally increased with cycling to produce a series of PIDC curves from which the photosensitivity and surface potentials at various exposure intensities were measured. Additional electrical characteristics were obtained by a series of charge-erase cycles with incrementing surface potential to generate several voltages versus charge density curves. The scanner was equipped with a scorotron set to a constant voltage charging at various surface potentials. The devices were tested at surface potentials of about 500 and about 700 volts with the exposure light intensity incrementally increased by means of regulating a series of neutral density filters. The exposure light source was a 780-nanometer light emitting diode. The aluminum drum was rotated at a speed of about 61 revolutions per minute to produce a surface speed of about 122 millimeters per second. The xerographic simulation was completed in an environmentally controlled light tight chamber at ambient conditions (about 50% relative humidity and about 22° C.).

Very similar PIDC curves were observed for both photoreceptor devices, thus the new undercoat layer, containing the polyol and melamine resins, performs very similarly to a conventional undercoat layer from the point of view of PIDC. The experimental device showed normal electrical propertied with similar residual voltage and charge acceptance to that of reference device. The Vdep, Vlow, dV/dX, Verase, and dark decay all suggest the new undercoat layer is functioning properly.

The above photoreceptor drums were then acclimated for 24 hours before testing J-zone conditions (70 F/10% RH) in a Copeland Work centre Pro 3545 machine using K station at t=0 and t=500 print count. Run-ups from t=0 to t=500 prints for all devices were done in one of the CYM color stations. Ghosting levels were measured against TSIDU SIR scale. The most stressful combination of Kutani CRUM and Tokai BCR was used for evaluating ghosting in the devices. This combination is known to give at least 1 to 2 grade higher ghosting than a more benign combination of Copeland CRUM and Tokai BCR.

The ghosting tests revealed that the new undercoat layer has ghosting levels of G1 at t=0 and G0 at t=500, which are significantly better than levels typically observed from regular three-component devices where ghosting is usually G6, even at t=0. The ghosting tests also revealed that the new undercoat layer performed much better than the conventional undercoat layer with UC79, which is typically G3 at t=0 and G4-4.5 at t=500, under the same stress conditions. Therefore, incorporation of polyol and melamine resins in combination with a metal oxide, such as titanium oxide, in the undercoat layer significantly improves print quality such as ghosting. The testing results show that this undercoat layer formulation exhibits essentially zero or low ghosting images even at the most severe testing condition.

What is claimed is:

1. An electrophotographic imaging member, comprising:
a substrate;
an undercoat layer disposed on the substrate, wherein the undercoat layer further comprises:
a polyol resin,
an aminoplast resin, and
a metal oxide dispersed therein; and
at least one imaging layer formed on the undercoat layer, wherein the polyol resin is present in an amount of from about 5% to about 80% by weight of the total weight of the undercoat layer and the aminoplast resin is present in an amount of from about 5% to about 80% by weight of the total weight of the undercoat layer, and the polyol resin is selected from the group consisting of acrylic polyols, polyglycerols and mixtures thereof, and further wherein the metal oxide has a size diameter of from about 5 to about 300 nm and a powder resistance of from about $1\times10^3$ to about $6\times10^4$ ohm/cm when applied at a pressure of from about 50 to about 650 kg/cm$^2$.

2. The electrophotographic imaging member of claim 1, wherein the aminoplast resins are selected from the group consisting of melamine-formaldehyde, urea-formaldehyde and mixtures thereof.

3. The electrophotographic imaging member of claim 1, wherein the metal oxide is selected from the group consisting of zinc oxide, tin oxide, aluminum oxide, silicon oxide, zirconium oxide, indium oxide, molybdenum oxide, and mixtures thereof.

4. The electrophotographic imaging member of claim 1, wherein the metal oxide is titanium oxide.

5. The electrophotographic imaging member of claim 1, wherein the least one imaging layer is a charge transport layer.

6. The electrophotographic imaging member of claim 1, wherein thickness of the undercoat layer is from about 0.1 μm to about 40 μm.

7. The electrophotographic imaging member of claim 1, wherein the metal oxide is present in an amount of from about 10% to about 90% by weight of the total weight of the undercoat layer.

8. The electrophotographic imaging member of claim 1 further including an optional crosslinking agent in the undercoat layer, the crosslinking agent being selected from the group consisting of p-toulenesulfonic acid, naphthalenesulfonic acid, phthalic acid, maleic acid, amine salts of inorganic acids, ammonium salts of inorganic acids, and mixtures thereof.

9. The electrophotographic imaging member of claim 1, wherein a weight/weight ratio of the polyol resin and the aminoplast resin in the undercoat layer is from about 5/95 to about 95/5.

10. An electrophotographic imaging member, comprising:
a substrate;
an undercoat layer disposed on the substrate, wherein the undercoat layer further comprises
an acrylic polyol resin,
a melamine-formaldehyde resin, and
titanium oxide dispersed therein; and
a charge transport layer formed on the undercoat layer, wherein the acrylic polyol resin is present in an amount of from about 5% to about 80% by weight of the total weight of the undercoat layer and the melamine-formaldehyde resin is present in an amount of from about 5% to about 80% by weight of the total weight of the undercoat layer.

11. The electrophotographic imaging member of claim 10, wherein the least one imaging layer is a charge transport layer.

12. The electrophotographic imaging member of claim 10, wherein thickness of the undercoat layer is from about 0.1 μm to about 40 μm.

13. An image forming apparatus for forming images on a recording medium comprising:
a) an electrophotographic imaging member having a charge-retentive surface to receive an electrostatic latent image thereon, wherein the electrophotographic imaging member comprises:
a substrate,
an undercoat layer disposed on the substrate, wherein the undercoat layer further comprises
an acrylic polyol resin,
a melamine-formaldehyde resin, and
a titanium oxide dispersed therein, and
at least one imaging layer formed on the undercoat layer, wherein the acrylic polyol resin is present in an amount of from about 5% to about 80% by weight of the total weight of the undercoat layer and the melamine-formaldehyde resin is present in an amount of from about 5% to about 80% by weight of the total weight of the undercoat layer;
b) a development component adjacent to the charge-retentive surface for applying a developer material to the charge-retentive surface to develop the electrostatic latent image to form a developed image on the charge-retentive surface;

c) a transfer component adjacent to the charge-retentive surface for transferring the developed image from the charge-retentive surface to a copy substrate; and d) a fusing component adjacent to the copy substrate for fusing the developed image to the copy substrate.

14. The image forming apparatus of claim 13, wherein the titanium oxide is present in an amount of from about 20% to about 80% by weight of the total weight of the undercoat layer.

15. The image forming apparatus of claim 13 further including an optional crosslinking agent in the undercoat layer, the crosslinking agent being selected from the group consisting of p-toulenesulfonic acid, naphthalenesulfonic acid, phthalic acid, maleic acid, amine salts of inorganic acids, ammonium salts of inorganic acids, and mixtures thereof.

16. The image forming apparatus of claim 13, wherein the titanium oxide is present in an amount of from about 10% to about 90% by weight of the total weight of the undercoat layer.

* * * * *